US009500441B2

(12) United States Patent
Kirby, Jr.

(10) Patent No.: US 9,500,441 B2
(45) Date of Patent: Nov. 22, 2016

(54) STORAGE CLIPBOARD WITH QUICK-ACCESS WEAPON HOLDER

(71) Applicant: Daniel Keith Kirby, Jr., Massillon, OH (US)

(72) Inventor: Daniel Keith Kirby, Jr., Massillon, OH (US)

( * ) Notice: Subject to any disclaimer, the term of this patent is extended or adjusted under 35 U.S.C. 154(b) by 0 days.

(21) Appl. No.: 14/402,568

(22) PCT Filed: May 21, 2013

(86) PCT No.: PCT/US2013/042049

§ 371 (c)(1),
(2) Date: Nov. 20, 2014

(87) PCT Pub. No.: WO2013/177180

PCT Pub. Date: Nov. 28, 2013

(65) Prior Publication Data

US 2015/0083616 A1 Mar. 26, 2015

Related U.S. Application Data

(60) Provisional application No. 61/650,266, filed on May 22, 2012.

(51) Int. Cl.
*B65D 85/00* (2006.01)
*F41C 33/06* (2006.01)
(Continued)

(52) U.S. Cl.
CPC ..... *F41C 33/06* (2013.01); *B42F 9/002* (2013.01); *F41C 33/0272* (2013.01)

(58) Field of Classification Search
CPC ..... F41C 33/06; F41C 9/02; B42F 1/02
(Continued)

(56) References Cited

U.S. PATENT DOCUMENTS 1,381,301 A 8/1920 Hargrave
2,851,076 A 7/1958 Stakofsky
(Continued)

FOREIGN PATENT DOCUMENTS

FR 2293017 A1 6/1976
WO 9514402 A1 6/1995
(Continued)

OTHER PUBLICATIONS

Sep. 12, 2013 Search report and Written Opinion PCT/US2013/042049.

*Primary Examiner* — Jacob K Ackun
*Assistant Examiner* — Jenine Pagan
(74) *Attorney, Agent, or Firm* — Zollinger & Burleson Ltd

(57) ABSTRACT

A storage clipboard has a quick-access weapon holder assembly wherein the storage clipboard has an exterior appearance that is the same as a conventional storage clipboard so as to not raise awareness of the existence of the weapon to a person viewing the container. The actuator is disposed in the bottom of a storage-style clipboard so that the user may actuate the weapon deployment with a finger of his hand holding the clipboard while grasping the weapon with the other hand. The clipboard may be configured to be carried by either hand of the user. When actuated, the weapon holder opens a door panel in the side of the clipboard to present the weapon in an accessible location.

23 Claims, 7 Drawing Sheets

(51) Int. Cl.
*F41C 33/02* (2006.01)
*B42F 9/00* (2006.01)

(58) Field of Classification Search
USPC ..... 206/317, 214, 215, 803; 42/1.09; 24/67 R, 67.7, 67.3, 67.5, 67.9, 67.11
See application file for complete search history.

(56) References Cited

U.S. PATENT DOCUMENTS 3,261,519 A 7/1966 Home
3,268,130 A 8/1966 Simpson
3,347,299 A 10/1967 Alexander
3,951,486 A * 4/1976 Tracy ..... B60R 7/043 220/482
4,016,666 A * 4/1977 Finn ..... F41C 9/00 42/1.01
4,020,930 A 5/1977 Weber
4,153,927 A * 5/1979 Owens ..... B43L 3/00 362/110
4,309,065 A 1/1982 Pappas
4,475,247 A 10/1984 Lee
4,919,037 A 4/1990 Mitchell
5,048,682 A 9/1991 Taylor
5,170,919 A 12/1992 DeSantis et al.
5,203,449 A 4/1993 Bonardi
5,495,967 A 3/1996 Parton
5,505,355 A 4/1996 Williams
5,584,424 A 12/1996 Stava
5,662,219 A 9/1997 Tschudy et al.
5,671,830 A 9/1997 Wood
5,823,500 A * 10/1998 La Coste ..... B43L 3/008 248/444
6,217,075 B1 4/2001 Tsai
6,405,861 B1 6/2002 Siler et al.
7,159,711 B1 1/2007 Gardner
7,299,667 B1 11/2007 Miresmaili
7,325,681 B2 2/2008 Schonenbach
7,434,427 B1 10/2008 Miresmaili
8,104,313 B2 1/2012 Wolfe
8,181,810 B2 5/2012 Jones
2003/0052147 A1 3/2003 Hughes et al.
2003/0057122 A1 3/2003 Bushnell et al.
2004/0056037 A1 3/2004 Gluck
2004/0163913 A1 8/2004 Tschudy
2008/0047860 A1 2/2008 Shane
2008/0197140 A1 8/2008 Cheslock
2010/0006735 A1* 1/2010 Reinen ..... A47B 23/043 248/451
2012/0073998 A1* 3/2012 He ..... B43L 3/005 206/216

FOREIGN PATENT DOCUMENTS

WO 2013177180 A1 11/2013
WO 2013177250 A1 11/2013

* cited by examiner

STORAGE CLIPBOARD WITH QUICK-ACCESS WEAPON HOLDER

CROSS REFERENCE TO RELATED APPLICATIONS

This application is a United States National Stage Patent Application filed under 35 U.S.C. §371 claiming priority to PCT/US2013/042049 having an international filing date of May 21, 2013. This application claims the benefit of U.S. Provisional Patent Application 61/650,266 filed May 22, 2012.

BACKGROUND OF THE DISCLOSURE

1. Technical Field

The disclosure generally relates to concealed weapon carriers and, more particularly, to a weapon holder concealed in a storage-style clipboard in a manner that allows the holder of the clipboard to obtain quick-access to a weapon in a quick and natural movement.

2. Background Information

An increasing number of jurisdictions allow citizens to carry concealed weapons and firearms. Some casual carriers do not wish to carry their weapon on their body but desire a method to carry the weapon in a ready-access location.

Other persons who need ready-access to a firearm or other weapon are security personnel charged with protecting dignitaries, businessmen, facilities, or government officials. These security personnel may carry one weapon in a traditional belt or shoulder holster while desiring ready access to another weapon. These persons also benefit from having ready access to a ballistic shield.

Many police officers and security personnel find themselves in confrontational or potentially confrontational situations where the police officer or security personnel is carrying a storage-style clipboard. A storage clipboard generally includes one or more integral storage boxes for transporting various accessories such as blank paper or forms, pens, pencils, erasers, rulers, calculators, etc. The writing surface of the clipboard is provided with a spring retaining clip for securing papers and is mounted by a hinge to a shallow rectangular box that defines portions of the storage boxes. A person holding a storage clipboard with one hand and writing with the other hand cannot readily draw a holstered weapon without providing a series of movements that telegraph the person's intent to a third party. This situation also occurs when the person is holding a storage clipboard with one hand a flashlight in another hand. When an officer is investigating a scene at night, the officer often holds a flashlight that illuminates the scene while taking notes on the clipboard. An officer in this situation finds himself at an undesirable disadvantage if he needs to quickly draw a weapon. Another common situation is when an officer approaches a driver's door of an automobile while carrying a storage clipboard and a flashlight during a traffic stop. Drawing a holstered weapon in these situations is not ideal.

SUMMARY OF THE DISCLOSURE

The disclosure provides configurations for a storage-style clipboard that have a quick-access weapon holder assembly. When triggered, the assembly moves from a concealed position to an accessible position. The weapon holder assembly may be accessed through a side or end wall of the clipboard box. The weapon carried by the weapon holder assembly may be a firearm, a chemical-based defense weapon, a baton, or an electricity-based (electroshock) weapon. The weapon holder assembly may include a holster designed to secure the weapon in the manner of a traditional holster so that the weapon is securely held by the weapon holder assembly and so the weapon does not unintentionally fall out of the holder assembly during normal use of the case. The movement of the weapon holder assembly is actuated without the need for the user to remove his hand from the normal case-carrying position. The normal case-carrying position is one wherein the user's hand is positioned at the middle of the side of a storage clipboard case.

The disclosure provides a storage clipboard having a quick-access weapon holder assembly wherein the storage clipboard has an exterior appearance that is the same as a conventional storage clipboard so as to not raise awareness of the existence of the weapon to a person viewing the container.

In one configuration, the actuator is disposed in the bottom of a storage-style clipboard so that the user may actuate the weapon deployment with a finger of his hand holding the clipboard while grasping the weapon with the other hand. The clipboard may be configured to be carried by either hand of the user. The user may select to carry the clipboard in the user's weak hand such that the weapon is deployed for grasping by the user's strong hand. For example, a left-handed person will carry the case in his right hand.

In each clipboard configuration, the weapon may be held within a traditional holster such that the weapon and holster may be move rapidly to the accessible position without causing the weapon to fall out of the holster. Such holsters may accommodate a weapon with lights or sights. In the configurations wherein the weapon holder assembly includes a holster, the retention force of the holster may be adjustable. The weapon holster may be carried by an assembly that rides on ball bearings for a fast and smooth and reliable deployment of the weapon. The assembly is designed in such a way that different holsters suited for different manufactures, models and calibers of weapons may be changed out to allow the case to deploy different weapons.

In one exemplary configuration of the clipboard, the disclosure provides a clipboard body having a plurality of compartments. Locating the weapon in a separate compartment prevents items that are normally carried in the clipboard storage compartment from interfering with the actuation mechanism or the weapon itself. This configuration also allows the clipboard to be opened without allowing the weapon to be viewed.

The different configurations may include anti-ballistic protection panels or the walls of the clipboard may be fabricated from or include anti-ballistic materials so that the clipboard may be used as a shield by the user after the weapon has been removed from the clipboard.

The clipboard may be counterweighted and balanced with a customizable weight that balances the weight of the weapon and holster held within the clipboard such that the clipboard may be carried in a natural way. The weight is removable and when the weapon is not loaded into the holster of the clipboard so it will be balanced without the weapon being present.

One configuration provides a safety mechanism that prevents deployment of the weapon. The safety may be a manual switch or an electronic switch such as a fingerprint scanner.

One configuration provides the case in the form of a storage clipboard having an upper panel that supports paper so that it can be written upon while the user holds the case. The case may include support rails to help the user grip the case. The case may be configured to have separate chambers for the weapon and papers so that the case may be used for its normal functions. The case also may have lights directed from its front and/or bottom surfaces to illuminate the area in front of and below the case while it is being held by the user. The clipboard-style case may include anti-ballistic panels and may include a neck strap so that the clipboard may be worn over the neck and function as a chest protector after the weapon is deployed.

BRIEF DESCRIPTION OF THE DRAWINGS

Similar numbers refer to similar elements throughout the specification. The different exemplary configurations described herein include elements which may be combined with elements of other configurations.

DESCRIPTION OF THE PREFERRED EMBODIMENT

Figure 4:
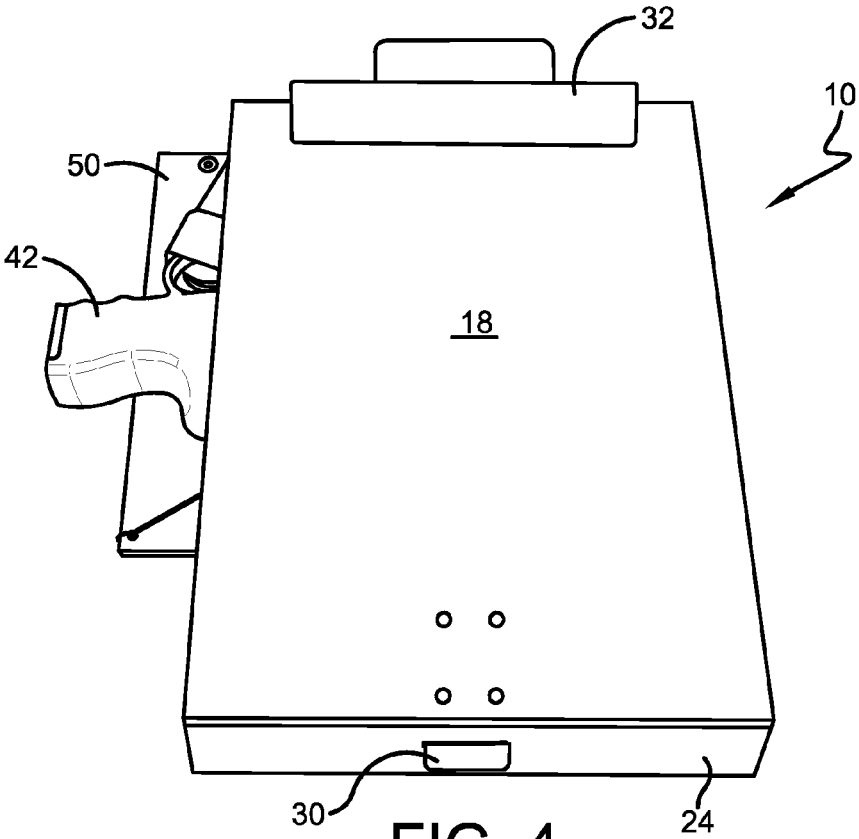
FIG. 4 is a top front perspective view showing the accessible position of the weapon holder through the left side of the case.
Figure 14:
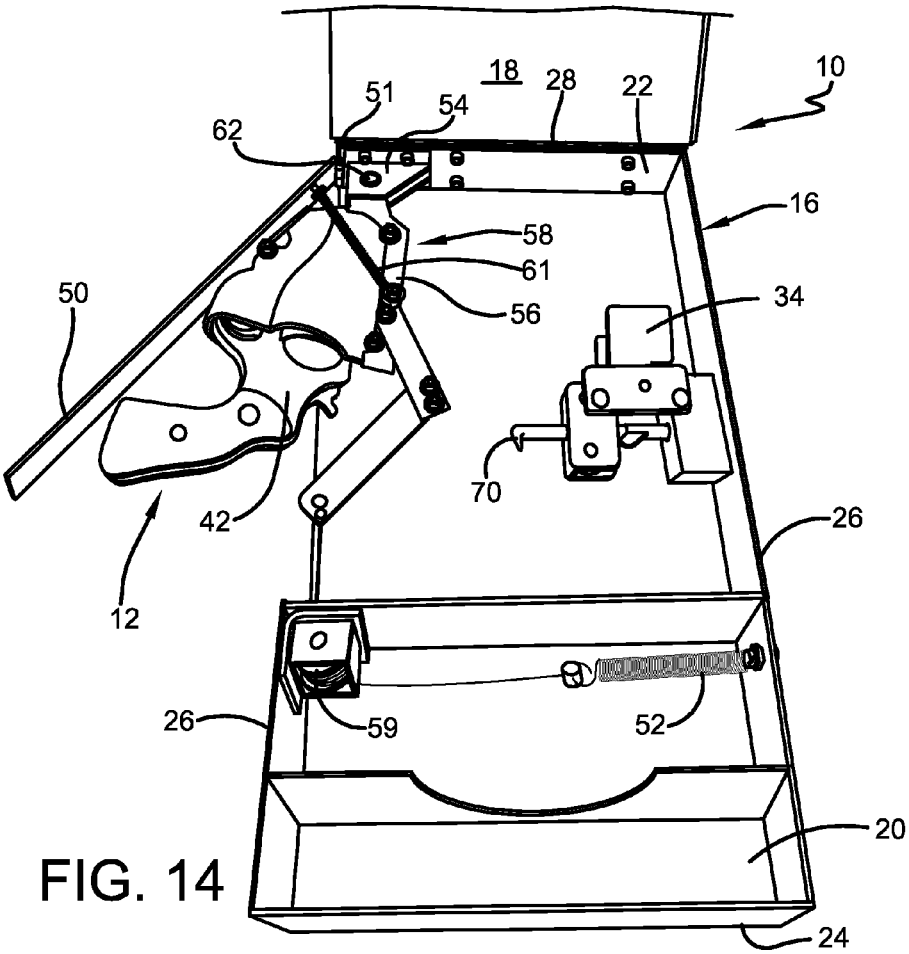
FIG. 14 shows the weapon holder assembly in the accessible position.

An exemplary storage-style clipboard (generally referred to herein as a case, a container, a clipboard, a storage clipboard, or a storage-style clipboard) having a quick-access weapon holder assembly is indicated generally by the numeral 10 in the accompany drawings. Clipboard 10 may be a hard-sided container in the shape of a traditional storage clipboard that has an upper writing surface with a biased clip combined with at least one integral storage box. In each of the configurations described herein, clipboard 10 includes a weapon holder assembly 12 that is movable between a concealed position (FIGS. 1, 2, 6, 10) to an accessible position (FIGS. 4, 14) through a wall or panel of clipboard 10. Weapon holder assembly 12 is configured to hold a firearm or a less-than-lethal device such as an electroshock weapon, a tear gas canister, a pepper spray canister, a knife, or any of a variety of batons. The movement of the weapon holder assembly 12 is actuated without the need for the user to remove his hand from the hand's normal carrying position 14 on clipboard 10. Further, the accessible position of weapon holder assembly 12 positions the weapon in a quick-access location for the user's other hand. The user may thus quickly deploy a weapon without signaling his intent to a third person. The hand's normal carrying position 14 for clipboard 10 is one wherein the user's hand is holding the middle of the edge of the body of clipboard 10. Clipboard 10 provides for delivery of the weapon to a location proximate the person's writing hand when clipboard 10 is held in this manner.

Clipboard 10 generally includes a body 16 that defines at least one storage chamber. Body 16 may be fabricated from a rigid material such as a metal or a plastic. Body 16 is generally in the form of a six-sided rectangular box and thus includes front 18 and rear 20 panels, a top end wall 22, a bottom end wall 24, and a pair of sidewalls 26. Front panel 18 is hinged to top end wall 22 with a hinge 28 so that front panel 18 may be moved between open and closed configurations. A latch 30 holds front panel 18 closed. Front panel 18 may include a downwardly projecting lip that overlaps portions of walls 24 and 26 when front panel 18 is closed. A biased clip 32 is carried by body 16 in a manner that allows paper to be clipped and held against the outer surface of front panel 18.

Body 16 may define a plurality of storage compartments such that the weapon holder assembly 12 may be separated from the storage of items. A separate compartment may be used to conceal weapon holder assembly 12. The weapon may be secured within a secure weapon container within body 16 that forms a separated container within clipboard 10. The secure weapon container prevents the weapon from being seen when clipboard 10 is opened during normal use. The weapon container also prevents items stored inside clipboard 10 from interfering with the weapon during normal use of clipboard 10. The secure weapon container may be secured with a lock (key or combination) that secures the container. Alternatively, the secure weapon container may be held closed with a plurality of connectors such that it is only openable when the connectors are removed.

Clipboard 10 includes an actuator 34 for deploying weapon holder assembly 12. The exemplary configuration of clipboard 10 depicted in the drawings is a version for a left-handed user wherein actuator 34 is positioned at the bottom of clipboard 10 where the fingers of the user's right hand are positioned when the user holds clipboard 10 with his right hand in the normal carrying position 14. This leaves the user's left hand near the left-hand side wall when the user is writing (or performing another task) such that the deployment of the weapon through the left-hand side wall minimizes the motion required by the user to access the weapon. In the exemplary configurations, actuator 34 is pushed inwardly by the user's finger or fingers to deploy weapon holder assembly 12. Actuator 34 is positioned through, in, or aligned with an opening defined by rear panel 20.

Clipboard 10 includes a pair of rails 38 disposed along or just inwardly of the lower edges of body 16 projecting downwardly away from bottom panel 20. Rails 38 provide grips for either hand of the user. Rails 38 help the user control the movement of clipboard 10. Each rail 38 may extend along the entire length of the edge, may be shorter than the edge, or may be provided in a plurality of spaced rail portions. Clipboard 10 may be held with a single hand and used as an anti-ballistic shield. Clipboard 10 also may include a neck strap 40 that allows the user to position clipboard 10 in front of his chest when the clipboard is release by both hands.

Body 16 may thus include integrated anti-ballistic panels in at least one major wall panel or all major walls. Body 16 may be manufactured from materials known to stop bullets or may be formed to include layers of such materials. When clipboard 10 has anti-ballistic properties, it may be held as a shield both before and after the weapon has been deployed. When clipboard 10 holds a firearm 42, the process of accessing firearm 42 and moving clipboard 10 up in front of the user are parts of the same motion. The user may then hold clipboard 10 in front of him as a shield with his hand on rail 38.

Figure 2:
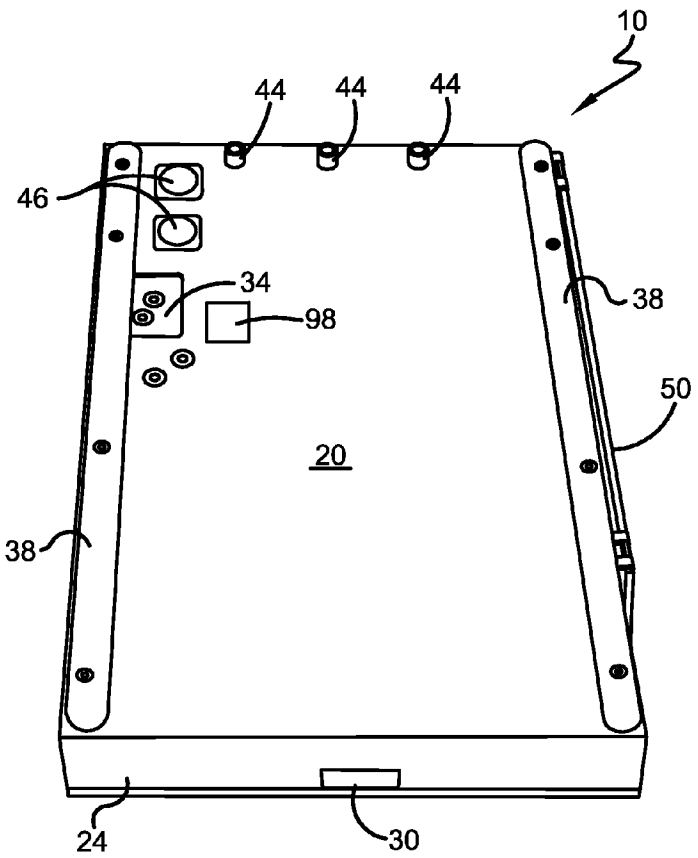
FIG. 2 is a bottom perspective view of the case of FIG. 1.
Figure 1:
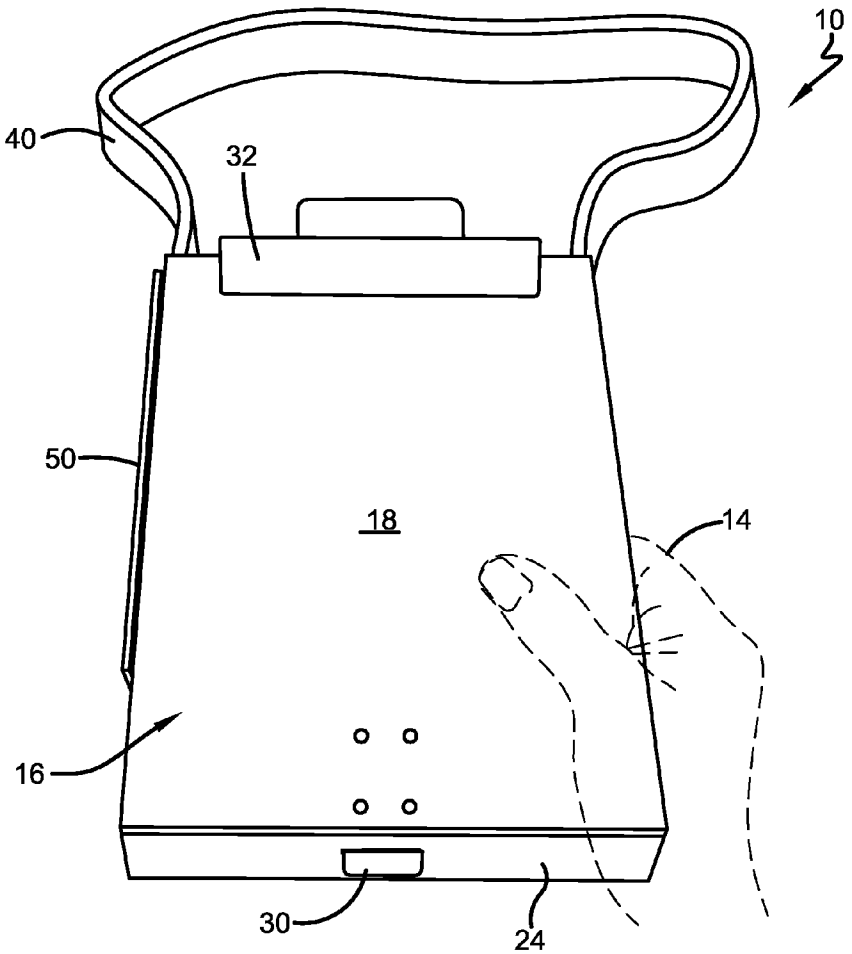
FIG. 1 is a top front perspective view of an exemplary configuration of case having a quick-access weapon holder assembly wherein the case is provided in the form of a storage clipboard.
Figure 3:
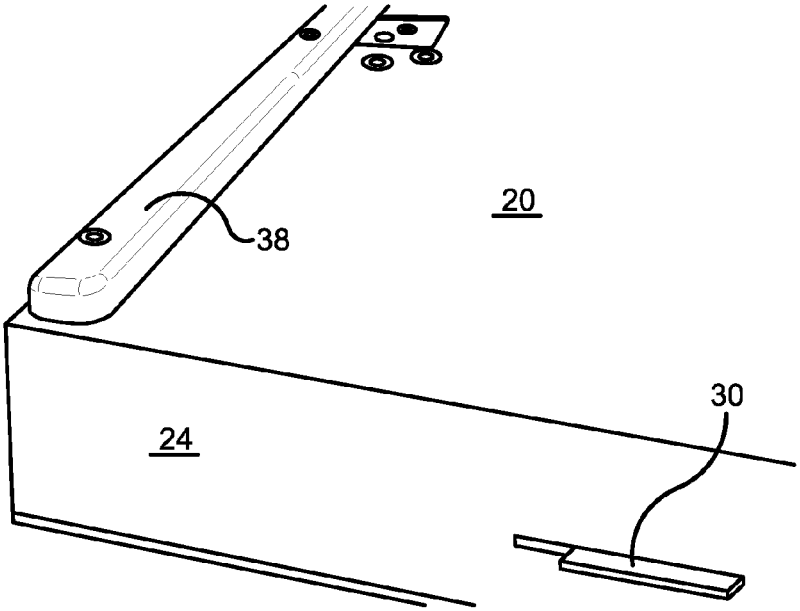
FIG. 3 is an enlarged view of a bottom corner showing a grip rail.

An optional configuration of clipboard 10 is shown in FIG. 2 wherein body 16 carries a light 44 or a plurality of lights 44 (traditional incandescent bulbs or light emitting diode (LED) elements) connected to a switch 46 and a power source 48. Lights 44 may be positioned in bottom panel 20 or in end wall 22 (or both) so that the light is directed toward the area the person holding clipboard 10 is viewing. Such lights 44 also may be used to limit the vision of a third party looking back at the person holding clipboard 10. Switch 46 is located near the natural holding position of the hand so the user can readily turn lights 44 on and off. Lights 44 allow the user to confirm the identity and assess if lethal force may be necessary. Lights 44 may be turned on and off independent from the weapon deployment mechanism for reasons such as illuminating a dark parking lot or walkway, illuminating a room, illuminating a lock in a dark area to make it easier to use a key to unlock a door. Power source 48 may be batteries and are located inside body 16.

A removable weight 49 may be used to balance clipboard 10. Batteries 48 may be used to balance the weight of the firearm 42 or weapon holder assembly 12.

Weapon holder assembly 12 generally includes a door panel 50 and a weapon holder 58 adapted to carry the weapon. Weapon holder 58 is pivotably carried by a base 54 that is secured to body 16. Base 54 supports weapon holder 58 with a hinge pin 62 that optionally includes bearings so that the movement of weapon holder 58 is smooth and reliable. Base 54 may be elongated and extend along at least a portion of or the entire length of end wall 22.

Weapon holder assembly 12 is biased toward the accessible position with at least one biased member 52. Biased member 52 may be a coil spring, a torsion spring, a leaf spring, a folded or rolled section of flat spring steel, or other biasing devices known in the art. Biased member 52 also may be a piston-cylinder mechanism that is biased toward the extended position. Biased member 52 also may be replaced with a motor used to drive assembly 12 to the accessible position.

In the first exemplary configuration, weapon holder 58 includes first 56 and second mounts 64 that secure the weapon. Second mount 64 is pivotably connected to base 54 and first mount 56 is biased by biased member 52. In the first configuration, biased member 52 is one or more coil springs which extend between first mount 56 and a portion of body 16 to pull mount 56 toward door panel 50. In the second exemplary configuration, spring 52 is connected to a cable that passes around a pulley 59 to pull on the end of an extension of upper mount 56. In the second configuration, first mount 56 is pivotably connected to base 54. In other configurations, springs 52 are directly attached to the holster instead of upper mount 56. In still other configurations, biased member 52 pushes on mount 58.

When the weapon carried by assembly 12 is a firearm 42, weapon holder 58 includes the portion of a traditional holster that is specifically configured for the firearm 42 being carried by case 10. Such traditional holsters securely retain firearm 42 and minimize the likelihood that firearm 42 will fall out of holder 58 when carried within clipboard 10. The retention force of this holster may be adjusted. In the first exemplary configuration, the traditional holster is carried between opposed portions of upper mount 56 and at least one portion of a lower mount 64. A plurality of connectors secure the holster to mounts 56 and 64 or just mount 56. The use of the traditional holster allows the user to change the type of firearm used with clipboard 10 by swapping the holster as needed. In some configurations, the holster itself is hinged to base 54.

Figure 5:
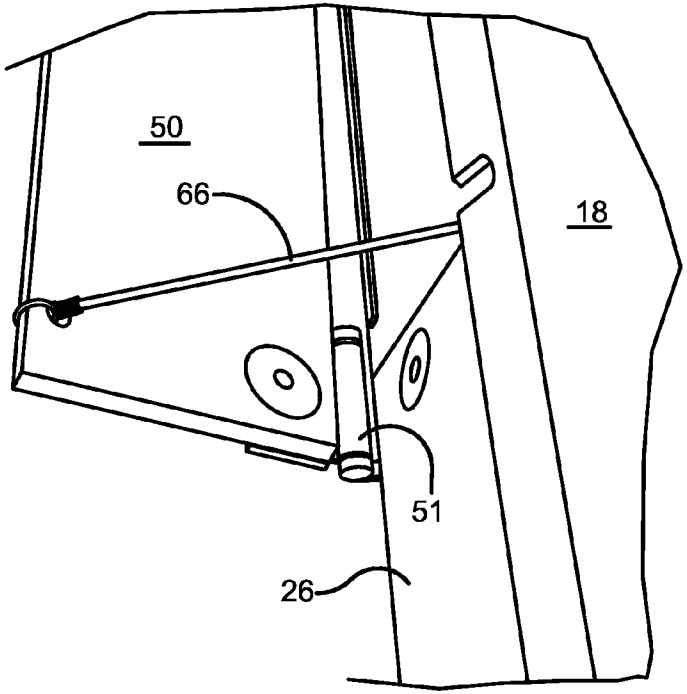
FIG. 5 is an enlarged view of the door panel in its open condition.
Figure 6:
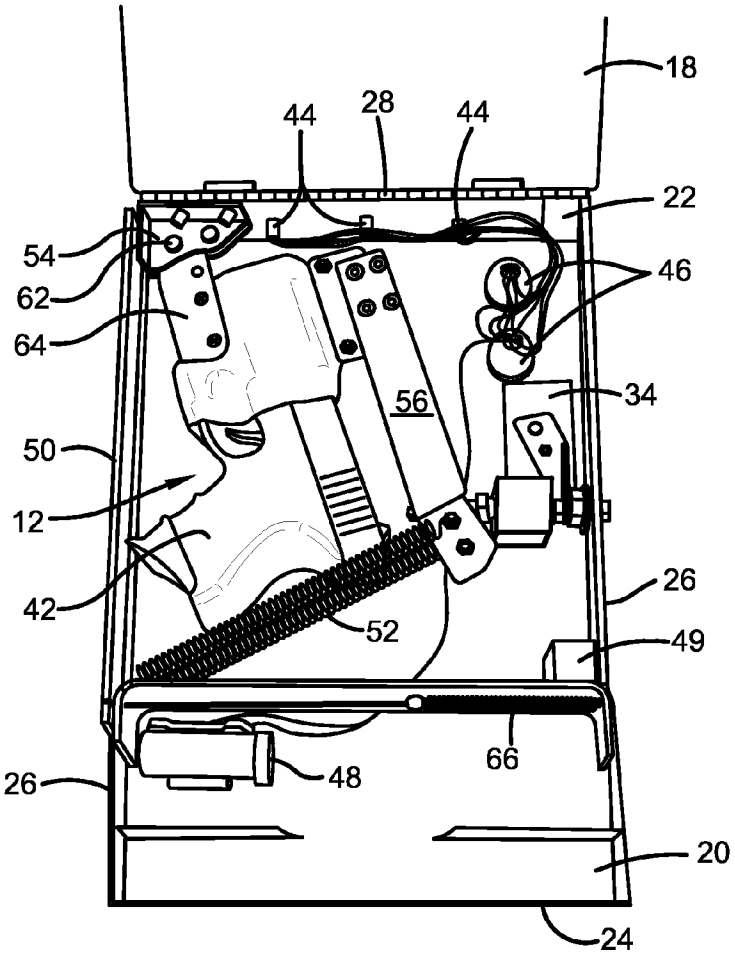
FIG. 6 is a top front perspective view of the case with the upper panel open and the weapon holder in the concealed position.
Figure 7:
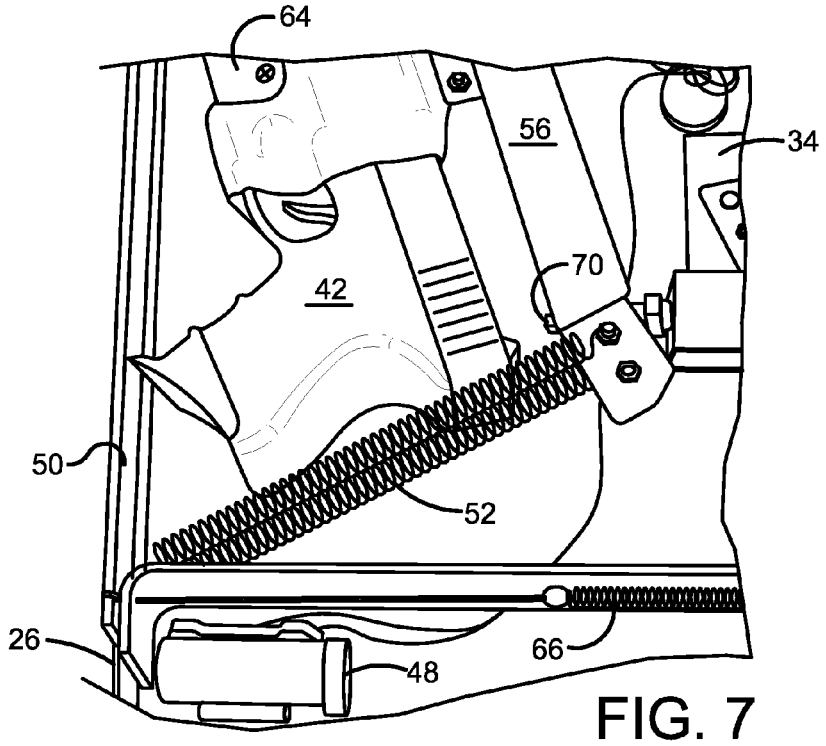
FIG. 7 shows how the weapon engages the inner surface of the door panel so that the weapon will push the door panel open.
Figure 8:
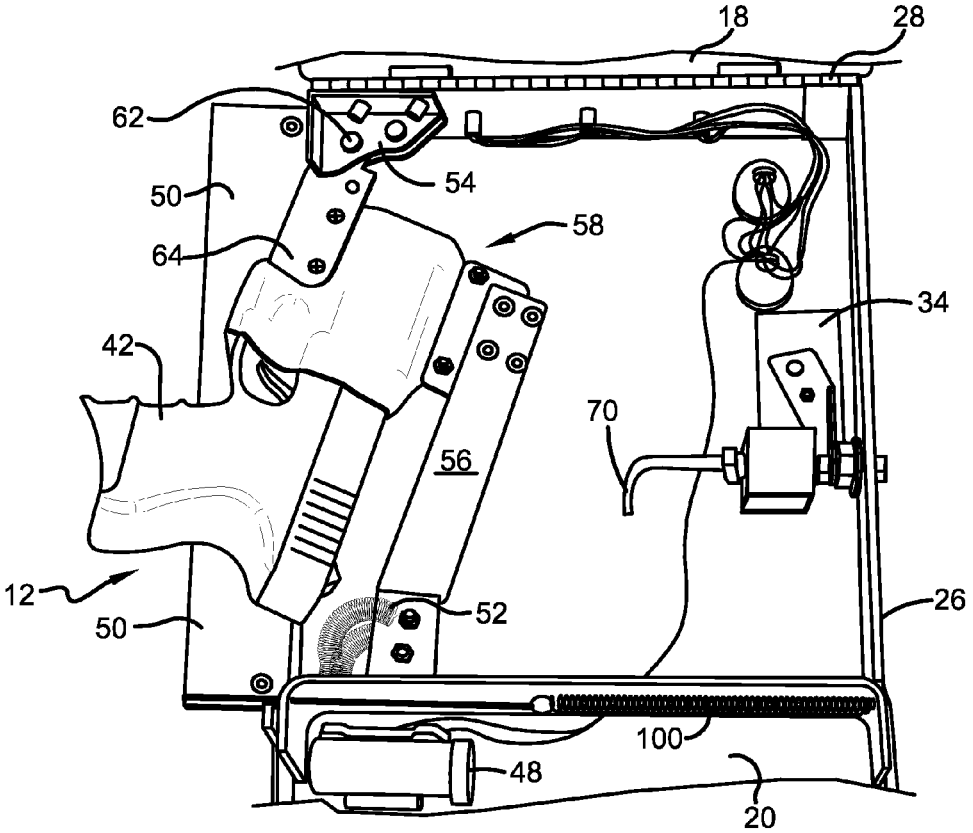
FIG. 8 shows the accessible position of the weapon holder with the upper panel open.
Figure 10:
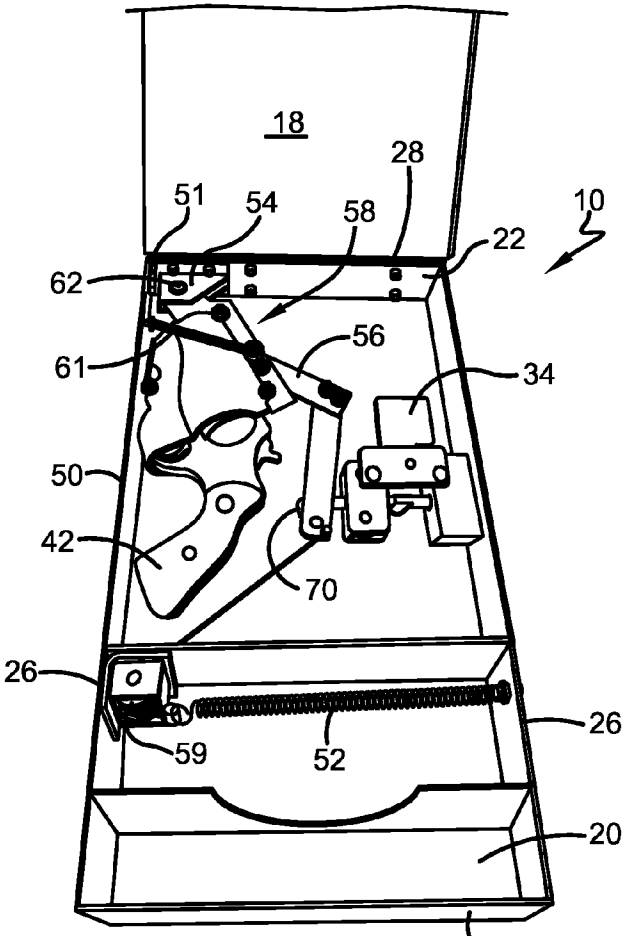
FIG. 10 shows the inside of the case configuration of FIG. 9.
Figure 9:
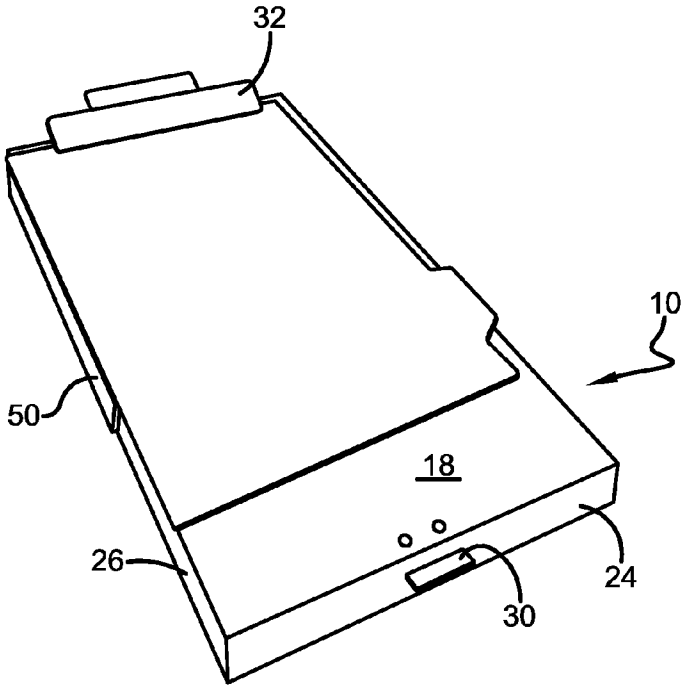
FIG. 9 shows an alternative configuration of the storage clipboard-style case.

In the first exemplary configuration, door panel 50 is connected to body 16 with a hinge 51 (FIG. 5) that allows door panel 50 to pivot from a closed condition to an open condition in a direction that is down and away from sidewall 26. As such, hinge 51 defines a pivot axis parallel to bottom panel 20 and perpendicular to end panels 22 and 24. Hinge 51 is generally parallel to the longitudinal dimension of body 16. In the closed condition, door panel 50 is generally parallel to sidewall 26 and perpendicular to bottom panel 20. In the closed condition, door panel 50 closes flush with sidewall 26 or in an overlapped condition. When weapon holder assembly 12 is in the concealed position, door panel 50 may close the opening in body 16 and function as part of the wall of body 16 through which weapon is accessed. Door panel 50 is biased closed with its own spring 66.

Figure 11:
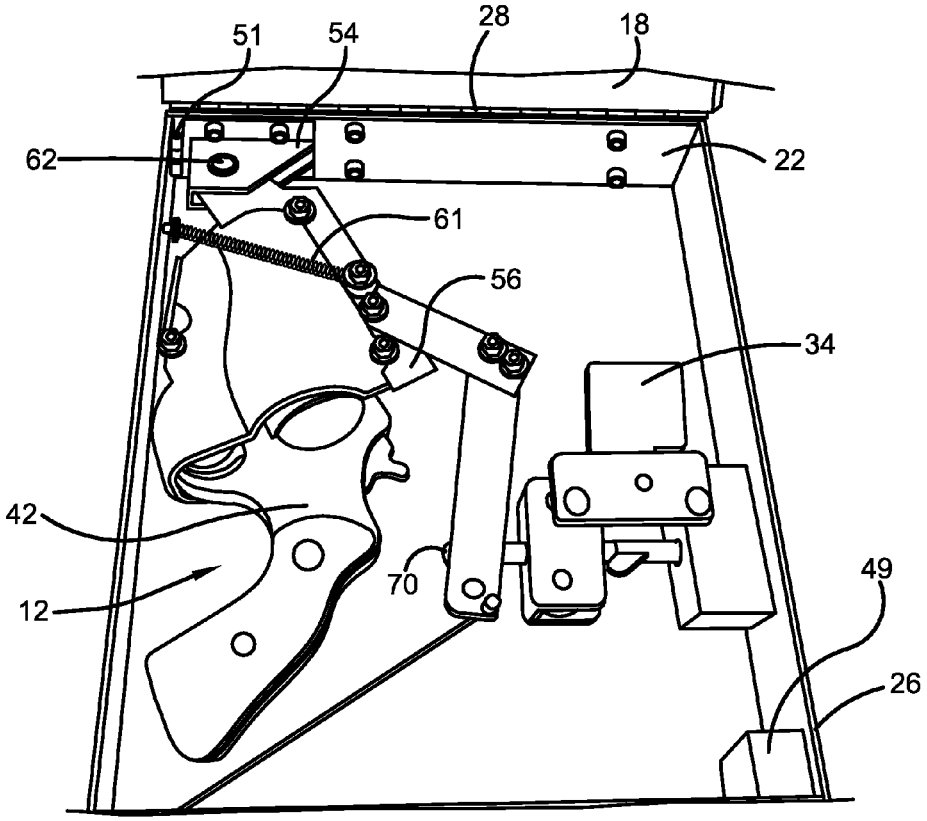
FIG. 11 shows an enlarged view of the actuator and portions of the spring that moves the weapon holder assembly.
Figure 12:
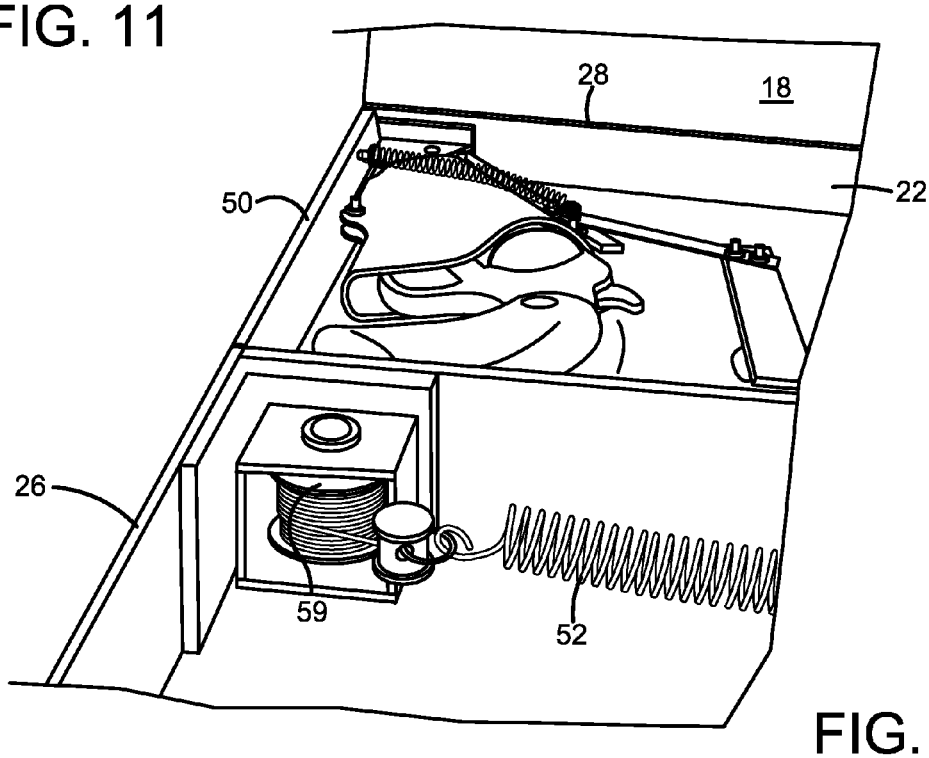
FIG. 12 is an enlarged view of the pulley which redirects the force of the spring.
Figure 13:
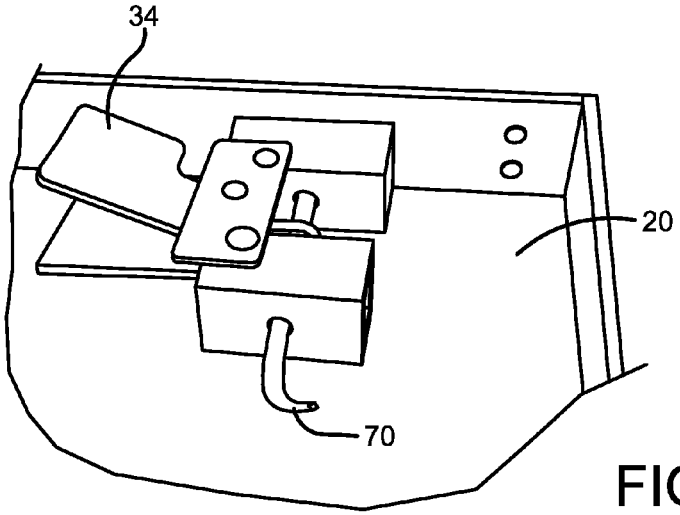
FIG. 13 is an enlarged view of the actuator after it has been pressed in to release the weapon holder assembly.

In the second exemplary configuration, door panel 50 is connected to body 16 with a hinge 51 (FIG. 11) that allows door panel 50 to pivot from a closed condition to an open condition in a direction that is out and away from sidewall 26. As such, hinge 51 defines a pivot axis perpendicular to bottom panel 20 and parallel to end panels 22 and 24. Hinge 51 is generally perpendicular to the longitudinal dimension of body 16. In the closed condition, door panel 50 is generally parallel to sidewall 26 and perpendicular to bottom panel 20. In the closed condition, door panel 50 closes flush with sidewall 26 or in an overlapped condition. When weapon holder assembly 12 is in the concealed position, door panel 50 may close the opening in body 16 and function as part of the wall of body 16 through which weapon is accessed. In the second exemplary configuration, weapon holder 58 includes only first mount 56 which carries weapon. A spring 61 connects door panel 50 to first mount 56 so that door panel 50 is pulled closed when holder 58 is pushed back into body 16.

Clipboard 10 includes a latch 70 that indirectly or directly holds door panel 50 in its closed position and assembly 12 in the concealed position until released by actuator 34. Latch 70 holds weapon holder 58 against the force of biased member 52 until latch 70 is moved by actuator 34. When released, the force of biased member 52 forces the weapon or a portion of holder 58 against door panel 50 causing it to open to allow weapon to be accessed by the user. In the exemplary configurations, actuator 34 is pivoted inwardly causing latch 70 to pivot and release its engagement with holder 58.

In any of these configurations, a safety latch 98 may be provided. Safety latch 98 may be a mechanical locking element that must be moved prior to moving latch 90. In another configuration, safety latch 98 is controlled by a fingerprint reader which scans the user's fingerprint and matches it with a recorded image before allowing the user to deploy the weapon.

The method of deploying the weapon is initiated when the user is carrying clipboard 10 in a normal carrying position that does not appear to be out of the ordinary. When the user needs to access the weapon, the user makes a natural motion without the need to remove his less dominate hand from its normal carrying position. This saves precious time and does not provide a clue to another that the user is moving to obtain a weapon.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A storage clipboard having a weapon holder that is movable between concealed and accessible positions; the storage clipboard comprising:

a body having at least a pair of sidewalls and a storage compartment; one of the sidewalls defining an opening;

a door panel movable between open and closed positions; the closed position of the door panel covering the opening defined by the sidewall;

a weapon holder carried by the body in the storage compartment; the weapon holder being movable between concealed and accessible positions; the weapon holder removably carrying a weapon;

the concealed position of the weapon holder positioning the entire weapon within the storage compartment;

the accessible position of the weapon holder positioning at least a portion of the weapon outside of the storage compartment through the opening defined by the sidewall;

a biased member urging the weapon holder toward the accessible position; and an actuator having first and second conditions; the first condition of the actuator holding the weapon holder in the concealed position; the second condition of the actuator allowing the biased member to move the weapon holder to the accessible position.

2. The clipboard of claim 1, wherein the body is rectangular and defines a storage chamber; the body including a bottom panel, a top end wall, a bottom end wall, and a top panel.

3. The clipboard according to claim 2, wherein the body includes rails projecting outwardly from the bottom panel.

4. The clipboard according to claim 2, further comprising a light carried by at least one of the bottom panel and the top end panel.

5. The clipboard according to claim 2, further comprising a neck strap connected to the body.

6. The clipboard according to claim 1, wherein the weapon holder pivots from the concealed position to the accessible position.

7. The clipboard according to claim 1, wherein the door panel pivots from the closed position to the open position.

8. The clipboard according to claim 7, wherein the door panel is connected to the body with a hinge disposed parallel to the bottom panel.

9. The clipboard according to claim 7, wherein the door panel is connected to the body with a hinge disposed perpendicular to the bottom panel.

10. The clipboard according to claim 1, further comprising a spring disposed between the body and the weapon holder.

11. The clipboard according to claim 1, further comprising a latch that engages the weapon holder; the actuator pivoting the latch to release the weapon holder.

12. The clipboard according to claim 11, further comprising a safety that prevents the actuator from changing from the first condition to the second condition.

13. The clipboard according to claim 1, wherein one of the weapon holder and the weapon engages the door panel to push it open as the weapon holder moves from the concealed position to the accessible position.

14. A storage clipboard having a weapon holder that is movable between concealed and accessible positions; the storage clipboard comprising:

a body having at least a front panel, a pair of sidewalls and a storage compartment; one of the sidewalls defining an opening;

the front panel functioning as a writing support surface;

a door movable between open and closed positions; the closed position of the door covering the opening defined by the sidewall;

a weapon holder carried by the body in the storage compartment; the weapon holder being movable between concealed and accessible positions; the weapon holder removably carrying a weapon;

the concealed position of the weapon holder positioning the entire weapon within the storage compartment;

the accessible position of the weapon holder positioning at least a portion of the weapon outside of the storage compartment through the opening defined by the sidewall;

a biased member urging the weapon holder toward the accessible position; and an actuator having first and second conditions; the first condition of the actuator holding the weapon holder in the concealed position; the second condition of the actuator allowing the biased member to move the weapon holder to the accessible position.

15. The clipboard of claim 14, further comprising a grip connected to the body; the actuator disposed near the grip such that a user can change the condition of the actuator with a finger of the hand holding the grip.

16. The clipboard according to claim 14, further comprising a light carried by the body.

17. The clipboard according to claim 14, wherein the body includes a bottom panel disposed substantially parallel to the top panel; the door being in the form of a door panel connected to the body with a hinge disposed parallel to the bottom panel.

18. The clipboard according to claim 14, wherein the body includes a bottom panel disposed substantially parallel to the top panel; the door being in the form of a door panel connected to the body with a hinge disposed perpendicular to the bottom panel.

19. The clipboard according to claim 14, wherein the door moves with the weapon holder.

20. A storage clipboard having a weapon holder that is movable between concealed and accessible positions; the storage clipboard comprising:

a body having at least a pair of sidewalls and a storage compartment; one of the sidewalls defining an opening;

a closure member movable between open and closed positions; the closed position of the closure member closing the opening defined by the sidewall;

a weapon holder carried by the body in the storage compartment; the weapon holder being movable between concealed and accessible positions; the weapon holder adapted to removably carry a weapon;

the concealed position of the weapon holder adapted to position the entire weapon within the storage compartment;

the accessible position of the weapon holder adapted to position at least a portion of the weapon outside of the storage compartment through the opening defined by the sidewall;

a biased member urging the weapon holder toward the accessible position; and an actuator having first and second conditions; the first condition of the actuator holding the weapon holder in the concealed position; the second condition of the actuator allowing the biased member to move the weapon holder to the accessible position.

21. The clipboard of claim 20, further comprising a grip connected to the body; the actuator disposed near the grip such that a user can change the condition of the actuator with a finger of the hand holding the grip.

22. The clipboard according to claim 21, further comprising a light carried by the body.

23. The clipboard according to claim 20, wherein the weapon holder pivots from the concealed position to the accessible position.

* * * * *